United States Patent [19]

Heile

[11] 3,933,671

[45] Jan. 20, 1976

[54] GERMICIDAL CLEANING COMPOSITION AND METHOD

[75] Inventor: Bernard Joseph Heile, Cincinnati, Ohio

[73] Assignee: The Procter & Gamble Company, Cincinnati, Ohio

[22] Filed: Feb. 27, 1974

[21] Appl. No.: 446,460

[52] U.S. Cl. ..... 252/107; 252/106

[51] Int. Cl.[2].. C11D 3/065; C11D 3/48; C11D 9/50

[58] Field of Search ..... 252/106, 107; 424/346, 424/347

[56] References Cited

UNITED STATES PATENTS

| | | | |
|---|---|---|---|
| 3,002,883 | 10/1961 | Butt et al. | 424/347 |
| 3,063,895 | 11/1962 | Pearson et al. | 424/347 |
| 3,503,885 | 3/1970 | Wedell | 252/105 |
| 3,538,217 | 11/1970 | Dewar et al. | 424/173 |
| 3,558,495 | 1/1971 | Mace | 252/106 |
| 3,594,322 | 7/1971 | Wilson | 252/106 |
| 3,703,472 | 11/1972 | Shaw | 252/106 |
| 3,824,190 | 7/1974 | Winicov et al. | 252/106 |

FOREIGN PATENTS OR APPLICATIONS

| | | |
|---|---|---|
| 2,050,641 | 2/1971 | France |
| 1,104,692 | 2/1968 | United Kingdom |

OTHER PUBLICATIONS

"Typical Properties of Dowfax Diphenyl Oxide Sulfonates," Dow Chem. Co., Rec'd P.O. Oct. 1971, pp. 1,3 and 4 (Sec. 3).

*Primary Examiner*—P. E. Willis, Jr.

*Attorney, Agent, or Firm*—Julius P. Filcik; Richard C. Witte

[57] ABSTRACT

A germicidal cleaning composition comprising anionic surfactant, tetrapotassium pyrophosphate, phenolic germicide, and hydrotrope. A method of cleaning and sanitizing hard surfaces is also presented.

1 Claim, No Drawings

GERMICIDAL CLEANING COMPOSITION AND METHOD

BACKGROUND OF THE INVENTION

1. Field of the Invention

The invention described herein relates to liquid germicidal cleaning compositions.

2. Description of the Prior Art

It is widely known to those skilled in the art of cleaning and sanitizing hard surfaces that phenol and substituted phenols are effective germicides. Two well known substituted phenol germicides are 4-chloro-2-cyclopentyl phenol, sold under the trade name Dowicide 9 by the Dow Chemical Company, Midland, Mich., and 2-benzyl-4-chlorophenol sold under the trade name Santophen 1 by Monsanto Company, St. Louis, Mo.

Previous workers, such as Rogers, In U.S. Pat. No. 2,614,060, and Partansky, in U.S. Pat. No. 2,359,240, have taught that phosphates such as sodium tripolyphosphate and potassium pyrophosphate, in water solution, enhance the germicidal activity of phenolic germicides.

Other workers, such as Peacock, in British Pat. No. 1,104,692, have demonstrated that it is possible to make heavy duty germicidal cleaners by mixing together a sufactant, a phosphate builder, a phenolic germicide and a hydrotrope.

While many useful germicidal cleaners have been described and made, they have heretofore suffered from one serious defect: none have been particularly effective against bacteria from the family Pseudomonodaceae. Bacteria from this family are responsible for meningitis, pneumonia, urinary tract infections, wound infections and burn infections. The ineffectiveness of germicidal cleaners against Pseudomonodaceae has caused severe problems in hospitals and clinics throughout the world. One particularly troublesome species of this family is *Pseudomonas aeruginosa*. A complete description of Pseudomonodaceae can be found in any of the standard bacteriological texts such as Bergey's *Manual of Determinative Bacteriology*, 7th Edition, (Baltimore, 1957) published by William and Wilkins Company.

BRIEF SUMMARY OF THE INVENTION

It is an object of the present invention to provide a composition of matter which demonstrates superior cleaning performance and which is effective in killing a wide range of bacteria including bacteria from the family Pseudomonodaceae. It is a further object of this invention to provide a method of cleaning and sanitizing hard surfaces in general, and more particularly, hard surfaces which are contaminated by bacteria from the family Pseudomonodaceae.

To accomplish the objects hereinbefore stated, there is provided a composition of matter which comprises a. an anionic surfactant selected from the group consisting of soaps, anionic synthetic detergents, and mixtures thereof;
b. tetrapotassium pyrophosphate;
c. a phenolic germicide selected from the group consisting of 4-chloro-2-cyclopentyl phenyl, 2-benzyl-4-chlorophenol, and mixtures thereof; and
d. a hydrotrope wherein (a) is present at from 1.5 to 4.5% (all percentages noted herein are percent by weight), (b) is present at from 8 to 15%, (c) is present at from 2.5 to 3.7% and (d) is present at from 10 to 25%.

The above-described composition of matter is an effective germicidal cleaner when used as is or when diluted with water at a ratio of one part cleaner to up to about 85 parts water.

The method of cleaning and sanitizing hard surfaces comprises providing a composition of matter as hereinbefore described, diluting one part by weight of the composition of matter with from 0 to about 85 parts water, and contacting the hard surface with the diluted composition of matter.

DETAILED DESCRIPTION OF THE INVENTION

The instant invention provides a germicidally active cleaning composition of matter which comprises a. an anionic surfactant selected from the group consisting of soaps, anionic synthetic detergents, and mixtures thereof;
b. tetrapotassium pyrophosphate;
c. a phenolic germicide selected from the group consisting of 4-chloro-2-cyclopentyl phenol, 2-benzyl-4-chlorophenol, and mixtures thereof; and
d. a hydrotrope wherein (a) is present at from 1.5 to 4.5%,
b. is present at from 8 to 15%,
c. is present at from 2.5 to 3.7% and
d. is present at from 10 to 25%.

Preferably, (a) is present at from 2 to 4%, (b) at from 12 to 15%, (c) at from 2.7 to 3.5%, and (d) at from 10 to 14%.

Component (a) of the composition is defined as a water-soluble soap or a synthetic anionic detergent. Mixtures of soaps and synthetic anionic detergents may also be used.

The soaps contemplated for use in the instant invention are the water-soluble salts of saturated fatty acids. The cationic portion of the soap molecule can be alkali metal, morpholine, ammonium, and substituted ammonium where the substituents are alkyl or hydroxy alkyl radicals containing from 1 to 3 carbon atoms. The anionic portion of the molecule can be a saturated fatty acid containing from 8 to 22 carbon atoms. The fatty acid may be either straight or branched chain, synthetic or derived from natural fats and oils. Preferably, the anionic portion of the soap molecule will contain from about 10 to about 18 carbon atoms. Examples of soaps which may be used in the instant invention are sodium decanoate, potassium dodecanoate, ammonium hexadecanoate, triethylammonium dodecanoate, triethylanol ammonium dodecanoate, the alkali metal salts of the mixed fatty acids derived from coconut oil and the alkali metal salts of the fatty acids derived from hydrogenated tallow. The most preferred soaps for use in the instant invention are the sodium and potassium salts of fatty acids containing from about 10 to about 14 carbon atoms and the sodium and potassium salts of fatty acids such as occur in coconut oil.

The synthetic anionic detergents contemplated for use in the present invention are well known to those skilled in the art. Listings of suitable materials may be found in many published sources such as *McCutcheon's Detergents and Emulsifiers*, 1973, *North American Edition* (1973, Ridgewood, N.J.) published by Allured Publishing Corporation. In the paragraph immediately following there is contained a non-limiting listing of suitable synthetic anionic detergents.

Anionic synthetic detergents useful in the present invention include the water-soluble salts, particularly the alkali metal salts, of organic sulfuric reaction products having in their molecular structure an alkyl radical containing from about 8 to about 22 carbon atoms and a radical selected from the group consisting of sulfonic acid and sulfuric acid ester radicals. (Included in the term alkyl is the alkyl portion of higher alcyl radicals.) Important examples of the anionic synthetic detergents useful in the present invention are the sodium or potassium alkyl sulfates, especially those obtained by sulfating the higher alcohols ($C_8 - C_{18}$ carbon atoms) produced by reducing the glycerides of tallow or coconut oil; sodium or potassium alkyl benzene sulfonates, in which the alkyl group contains from about 9 to about 15 carbon atoms, including those of the types described in U.S. Pat. Nos. 2,220,099 and 2,477,383 (the alkyl radical can be a straight or branched aliphatic chain); sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about 1 to 6 moles of ethylene oxide; sodium or potassium salts of alkyl phenol ethylene oxide ether sulfate with about 1 to about 10 moles of ethylene oxide per molecule and in which the alkyl radicals contain from 8 to about 12 carbon atoms; the reaction product of fatty acids esterified with isethionic acid and neutralized with sodium hydroxide where, for example, the fatty acids are derived from coconut oil, sodium or potassium salts of fatty acid amide of a methyl tauride in which fatty acids, for example, are derived from coconut oil; and others known in the art, a number specifically set forth in U.S. Pat. Nos. 2,486,921, 2,486,922 and 2,396,278. Other important anionic synthetic detergents are the sulfonated olefins, described in U.S. Pat. No. 3,488,384.

Still other important anionic synthetic detergents are the water-soluble salts of alkyl diphenyl ether disulfonates such as those described in U.S. Pat. No. 3,002,883. Still other suitable anionic synthetic detergents are the phosphate mono- and di-esters of the formula

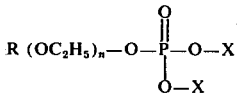

or

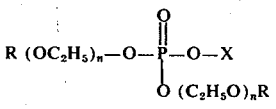

wherein R is a hydrocarbon group (preferably an alkyl or alkyl phenol group) containing from about 8 to about 150 carbon atoms, n is an integer from 0 to about 30, X is a water-soluble cation, such as alkali metal. These anionic synthetic detergents can be prepared as shown in U.S. Pat. No. 3,352,790.

A preferred anionic synthetic detergent is the sodium salt of the sulfuric acid ester of the reaction product of 1 mole of coconut fatty alcohol with about 3 moles of ethylene oxide ($NaAE_3S$). Highly preferred for use in the instant invention is a mixture of the aforesaid $NaAE_3S$, the sodium salt of n-decyl diphenyl ether disulfonate, and the potassium salt of fatty acids derived from coconut oil (i.e., potassium coconut soap) wherein the ratio of $NaAE_3S$ to diphenyl ether disulfonate is from about 1.0:1 to about 1.6:1 and the ratio of potassium coconut soap to diphenyl ether disulfonate is from about 0.2:1 to about 0.6:1. The sodium n-decyl diphenyl ether disulfonate is sold under the trade name Dowfax 3B2 by the Dow Chemical Company of Midland, Mich.

In general, cationic zwitterionic, ampholytic, and nonionic detergents should not be used in the instant compositions because of their well known tendency to reduce the activity of phenolic germicides.

Component (b) is tetrapotassium pyrophosphate (TKPP). This component, which is present at from about 8 to about 15%, preferably from about 12 to about 15%, serves as a contributor to the high cleaning efficiency of the composition and as an enhancer of the effectiveness of the phenolic germicides. Other well known detergency builders such as the alkali metal carbonates and bicarbonates, the alkali metal tripolyphosphates, the alkali metal hexametaphosphates, the water-soluble salts of methane-1-hydroxy-1,1-diphosphonic acid, and the water-soluble salts of ethylene diamine tetraacetic acid may be optionally added to the composition along with the required TKPP.

Component (c) of the instant composition is a phenolic germicide selected from the group consisting of 4-chloro-2-cyclopentyl phenol (CCPP) and 2-benzyl-4-chlorophenol (BCP). CCPP is sold by the Dow Chemical Company, Midland, Mich. under the trademark Dowicide 9; BCP is sold by Monsanto Company, St. Louis, Mo. under the trademark Santophen 1. While both of these phenolics are well known as being effective against a wide variety of microorganisms, they are also well known to be relatively weak against bacteria of the family Pseudomonodaceae. The heart of the present invention is the extension of the already broad spectrum activity of these two phenolic germicides to encompass cidal activity against the bacteria of the family Pseudomonodaceae. Either CCPP or BCP may be used in the instant invention at from about 2.5 to about 3.7%. Mixtures of the two phenolic germicides, in all proportions, may be used at the same levels. The preferred range of use of these two materials is from about 2.7 to about 3.5%.

Other phenolic germicides are compatible with the CCPP and the BCP and may optionally be used in the present invention along with the required CCPP, BCP, or mixtures of the two. However, the inclusion of these additional materials is generally considered to be unnecessary because of the high level of broad spectrum activity achieved by CCPP and BCP or mixtures of the two as used in the instant invention.

Component (d) is a hydrotrope. Examples of materials useful in the instant invention as the hydrotrope include the alkali metal salts of toluene sulfonic acid, xylene sulfonic acid and cumene sulfonic acid. Mixtures of these materials may also be used. Highly preferred for use in the present invention is potassium toluene sulfonate (KTS).

In order to obtain a composition of matter which is physically stable and which demonstrates cidal activity against bacteria of the family Pseudomonodaceae, it is critical that at least 10% hydrotrope be present in the composition. While up to 25% hydrotrope can be used, the preferred range is from 10% to about 14%.

In addition to the four necessary components listed above (i.e. anionic surfactant, TKPP, phenolic germicide, and hydrotrope) certain optional materials may be added to the composition. Examples of such materials are water-miscible solvents which serve as freeze thaw stability enhancers. Examples of these solvents are ethanol, propanol, isopropanol, and ethylene glycol. Isopropanol is a preferred water-miscible solvent. These solvents may be present at from about 0.5% to about 4%. Anti-oxidants such as sodium sulfite, citric acid, and sodium nitrite may also be used to advantage in the composition to prevent darkening of the phenolic germicide. Materials such as dyes, pigments, and perfumes which contribute to the aesthetic characteristics of the composition may also be optionally used.

To prepare the germicidal cleaning composition as hereinbefore described, the appropriate quantities of the components are added to soft water at room temperature with gentle agitation. While in general the order of addition is immaterial, the following order has been found to be convenient: the soap if used (it is to be understood that preformed soap may be used in this composition or, optionally, soap may be formed in situ by blending together in aqueous solution the appropriate alkali metal hydroxide and the appropriate fatty acid), the hydrotrope, the TKPP, the anionic synthetic detergent if used, the water-miscible solvent if used, the phenolic germicide, and the balance of the optional ingredients such as anti-oxidants, dyes, perfumes, and salts.

The instant compositions may be used as is for cleaning and sanitizing hard surfaces. That is to say, the concentrated composition as hereinbefore described may be applied directly to a hard surface in order to clean and sanitize the surface. More commonly, and preferably, the composition is diluted with water prior to its use as a sanitizing cleaner. Any convenient dilution up to about 85 parts by weight water to 1 part concentrated composition may be used. Preferably, 1 part germicidal cleaner composition will be added to from about 50 to about 75 parts water with 1 part germicidal cleaner composition to about 64 parts water being optimal.

The method of use of the invention comprises providing a concentrated germicidal cleaner as hereinbefore described, diluting said germicidal cleaner with from 0 to about 85 parts by weight water, preferably from about 50 to about 75 parts water, to each part concentrated germicidal cleaner, and contacting a soiled surface which may be contaminated with bacteria including bacteria of the family Pseudomonodaceae with said diluted germicidal cleaner composition.

In order to more fully describe the instant invention, the following examples are offered by way of illustration and not limitation:

EXAMPLE I

The following materials were mixed in the order listed, at room temperature with gentle agitation, in order to form a concentrated germicidal cleaning composition:

| | |
|---|---|
| Soft Water | 66.7 parts by weight |
| Potassium hydroxide | 0.1 |
| Coconut fatty acids | 0.36 |
| KTS | 11.0 |
| TKPP | 13.2 |
| $NaAE_3S$ | 1.3 |
| Dowfax 3B2 | 1.0 |
| Isopropanol | 2.0 |
| CCPP | 3.0 |
| Sodium Sulfite | 1.0 |
| Perfume | 0.3 |
| Dye | 0.0004 |

Laboratory cleaning tests of the germicidal cleaner at a dilution of one part cleaner in 64 parts water were conducted. In these tests, a white vinyl tile panel was soiled with an artificial soil compounded of humus, fat, cement, silicagel, clay, gelatin, sodium chloride, carbon black, and iron oxide. The panels were cleaned using the diluted germicidal cleaner of Example I on a sponge drawn across the panels by a Gardner Straight Line Washability and Abrasion Machine. Dirty panels were assigned a visual grade of 1.0; unsoiled panels were assigned a visual grade of 10.0. After 20 cycles of the cleaner-soaked sponge by the Gardner machine, the dirty panels had been cleaned to an average visual grade of 8.5. This test indicates that the germicidal cleaner of Example I effectively cleans soiled surfaces.

To test the germicidal effectiveness of Example I, the cleaner, still at a dilution of 1 to 64, was tested in the A.O.A.C. 11th Edition Use — Dilution Confirmation Test against three organisms. Three separate replicates of tests using the indicated number of tubes were performed with the results shown in Table 1.

Table 1

Results: A.O.A.C. Use - Dilution Confirmation Test
Example I at 1:64 Dilution

| Organism | | | | | |
|---|---|---|---|---|---|
| *Staphylococcus aureus* | | *Solmonella choleraesuis* | | *Pseudomouos aeruginosa* | |
| Growth (No. Tubes) | No. Tubes Tested | Growth (No. Tubes) | No. Tubes Tested | Growth (No. Tubes) | No. Tubes Tested |
| 0 | 60 | 0 | 60 | 0 | 30 |
| 0 | 60 | 0 | 60 | 0 | 30 |
| 0 | 60 | 0 | 60 | 0 | 30 |

The data of Table 1 indicates Example I is effective against several bacteria including a member of the family Pseudomonodaceae.

EXAMPLE II

The composition of Example I was duplicated except the CCPP was replaced with BCP. When the A.O.A.C. Use — Dilution Confirmation Test was conducted on this sample using *Pseudomous aeruginosa*, no growth was observed in any of 20 tubes. It is apparent, then, that the germicidal cleaner of Example II is effective against members of the family Pseudomonodaceae.

EXAMPLE III

The CCPP of Example I was replaced with pentachlorophenol, a common, normally effective germicide. When the A.O.A.C. Use Dilution Confirmation Test was conducted against *P. aeruginosa*, growth was observed in 19 of 20 tubes indicating a lack of effectiveness against this organism.

EXAMPLE IV

In the composition of Example I, 63.6% of the KTS was replaced with soft water (i.e. Example IV contains 4% KTS rather than 11.0%). A precipitate was immediately formed indicating the composition to be physically unstable.

EXAMPLE V

In the composition of Example I, 4.5 parts water was replaced with 2.4 parts sodium bicarbonate and 2.1 parts sodium carbonate. The cleaning effectiveness of the composition, at a dilution of 1 in 64, was not diminished.

What is claimed is:

1. A concentrated, physically stable, aqueous germicidal cleaning composition which provides cidal activity against bacteria of the family Pseudomonodaceae consisting of:

| | |
|---|---|
| Soft Water | 66.7 parts |
| Potassium Hydroxide | 0.1 part |
| Coconut Fatty Acids | 0.36 part |
| Potassium Toluene Sulfonate | 11.0 parts |
| Tetra Potassium Pyrophosphate | 13.2 parts |
| Sodium Salt of the Sulfuric Acid Ester of the Reaction Product of 1 mole of Coconut Fatty Alcohol with about 3 moles of Ethylene Oxide ($NaAE_3S$) | 1.3 parts |
| Sodium n-decyl diphenyl ether disulfonate | 1.0 parts |
| Isopropanol | 2.0 parts |
| 4-chloro-2-cyclopentyl phenol (CCPP) | 3.0 parts |
| Sodium Sulfite | 1.0 parts |

said parts being by weight.

* * * * *